United States Patent [19]

Kuna et al.

[11] 4,171,813

[45] Oct. 23, 1979

[54] BOARD GAME APPARATUS AND CHANCE MEANS

[75] Inventors: Wayne A. Kuna, Elmhurst; Howard J. Morrison, Deerfield; Jeffrey D. Breslow, Highland Park, all of Ill.

[73] Assignee: Marvin Glass & Associates, Chicago, Ill.

[21] Appl. No.: 876,411

[22] Filed: Feb. 10, 1978

[51] Int. Cl.[2] ..... A63F 3/00

[52] U.S. Cl. ..... 273/237; 273/141 A

[58] Field of Search ..... 273/138 A, 141 A, 142 A, 273/142 B, 142 JC; 46/228

[56] References Cited

U.S. PATENT DOCUMENTS

| | | | |
|---|---|---|---|
| 1,151,390 | 8/1915 | Prina | 273/142 A |
| 3,162,979 | 12/1964 | Garoogian | 46/228 |
| 3,834,711 | 9/1974 | Breslow | 273/141 A |

*Primary Examiner*—Vance Y. Hum

*Assistant Examiner*—R. Carl Moy

*Attorney, Agent, or Firm*—Mason, Kolehmainen, Rathburn & Wyss

[57] ABSTRACT

A chance device for randomly selecting one of a plurality of radial directions on a game board. The device includes a housing defining an internal cavity and a plurality of light transmitting apertures defined generally around the periphery of the housing. An illuminator is rotatably mounted within the housing by an indexing mechanism causing the illuminator to stop adjacent one of the apertures. The chance device further includes a switch for alternately energizing the illuminating device at the termination of rotation to direct a flashing beam through the selected aperture. The game board includes a position for mounting the chance device and radial indicia extending away from the chance device in directions aligned with the apertures defined in the housing.

16 Claims, 4 Drawing Figures

BOARD GAME APPARATUS AND CHANCE MEANS

BACKGROUND OF THE INVENTION

1. Field of the Invention

The present invention relates to games and in particular to a new and improved board game having a chance device for randomly selecting radial directions on the game board.

2. Brief Description of the Prior Art

There are many different chance devices such as a roulette wheel that are used for the selection of numbers or colors. Typically, prior art chance devices are solely for the purpose of designating a random number, a color or a combination thereof. Applicants are not aware of any chance devices, however, that select a purely random radial direction or any chance devices that use a centrifically energized source of illumination to designate the randomly selected direction. However, a top which utilizes centrifugal force to complete an electric circuit is shown in U.S. Pat. No. 3,191,344. In addition, game boards that may be included with prior art chance devices primarily include indicia of a selected color or numeral that are selected by the chance device or by the positioning of an object on the game board.

SUMMARY OF THE INVENTION

An object of the present invention is to provide a new and improved chance device for randomly selecting a radial direction.

Another object of the present invention is to provide a new and improved chance device for randomly selecting a radial direction on a related game board.

A further object of the present invention is to provide a new and improved chance device for randomly selecting a radial direction through the employment of an illumination source that is beamed along the selected radial direction.

An additional object of the present invention is to provide a new and improved chance device for randomly selecting a radial direction using a light source and a related game board including indicia corresponding to radially extending lines located in accordance with those directions that may be randomly selected by the chance device.

The present invention is directed to a new and improved chance device and to a related game board. The chance device includes a housing defining an internal chamber and a plurality of circumferentially spaced apertures defined in the housing. A source of illumination is rotatably mounted within the chamber and energized by a switch mechanism that intermittently energizes the source at the termination of rotation causing a flashing effect. The device further includes an indexing mechanism to stop the rotation of the illumination source at a randomly selected aperture thus providing the random selection feature of the chance device. The present invention is also directed to a game board that includes a location on which the chance device is positioned and indicia in the form of radial lines that extend from the location at which the chance device is positioned. Player stations may be defined on this board and other game articles may be positioned on the radial lines.

BRIEF DESCRIPTION OF THE DRAWINGS

The above and other objects and advantages and novel features of the present invention will become apparent from the following detailed description of a preferred embodiment of the invention illustrated in the accompanying drawings, wherein.

DESCRIPTION OF THE PREFERRED EMBODIMENT

Figure 1:
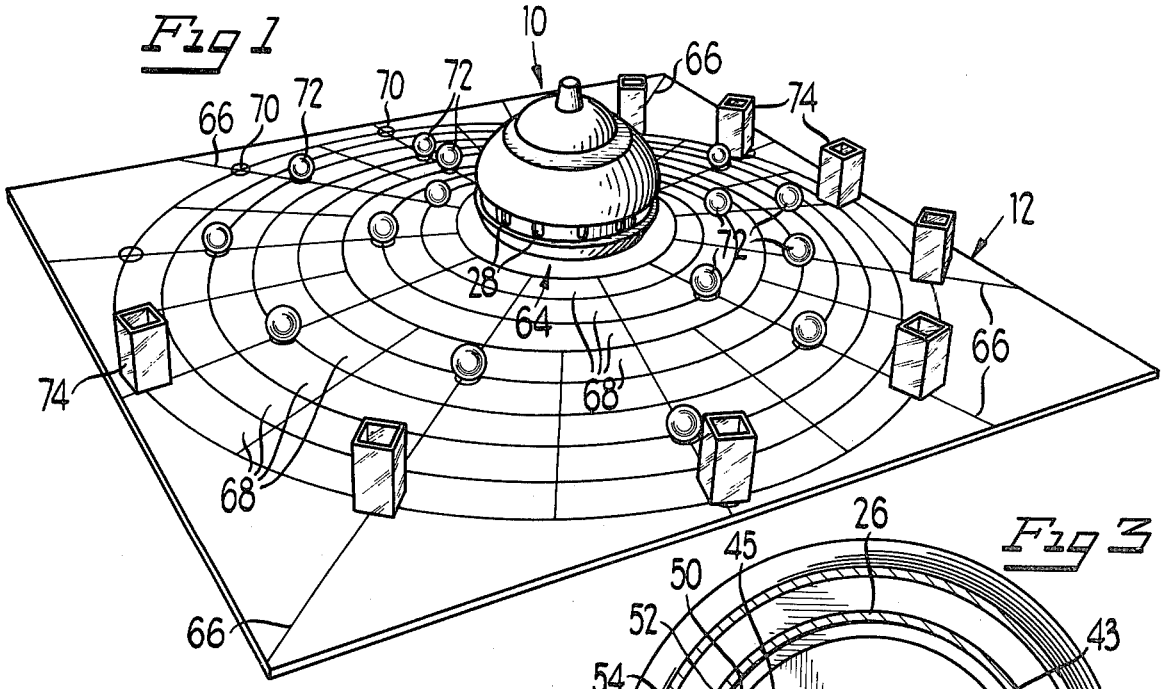
FIG. 1 is a perspective view of a board game including a chance device and a related game board constructed in accordance with the principles of the present invention.

Having reference to the drawings, and initially to FIG. 1, the present invention discloses a chance device generally designated by the reference numeral 10 and a related game board generally designated by the reference numeral 12. The chance device 10 is operative to select, in a random fashion, a radial direction that corresponds to indicia defined on the game board 12. The invention includes a set of rules so that a game may be played combining the random selection function of the chance device and the playing board 12.

The chance device 10 includes a housing, generally designated by the reference numeral 14, having an upper portion 16 and a lower base portion 18. The base portion 18 includes a flat or planar bottom 20 to allow it to be placed upon a surface such as the game board 12. The upper portion 16 and lower portion 18 of the housing 14 define an internal chamber 22 and, in the preferred embodiment, are of a circular or rounded configuration with a middle circumferential slot or void 24 defined at approximately the mid-section of the housing 14 to resemble a space ship "Galactic Cruiser" or other Unidentified Flying Object (U.F.O.).

The housing 14 further includes an internal cylindrical wall structure 26 that delineates the internal chamber 22. A plurality of apertures 28 or windows are provided in the cylindrical wall 26 at the mid-section void of the housing 14. The bottom housing portion 18 also includes an integral, upstanding post or pin 30 on which a spindle 32 is rotatably mounted.

Figure 3:
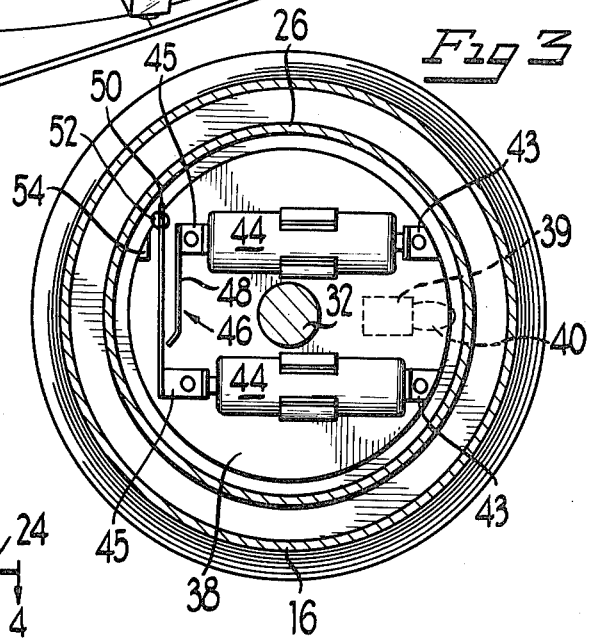
FIG. 3 is a view taken along line 3—3 in FIG. 2.
Figure 2:
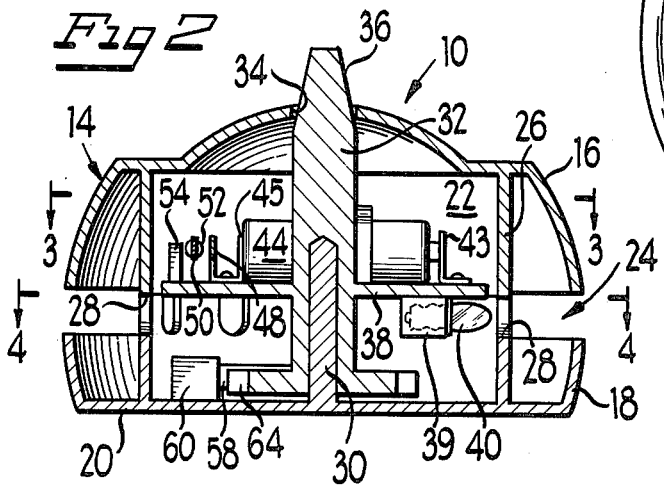
FIG. 2 is a vertical, cross-sectional view of the chance device of FIG. 1.

The upper portion 16 of the housing 14 includes a central aperture 34 through which the tapered top end 36 of the spindle 32 is supported and extends. The tapered end 36 may be grasped by the fingers of the player of the chance device 10 and spun to rotate the spindle 32 on the pin 30 relative to the housing 14. An integral, circular platform 38 is secured or integrally molded to the spindle 32 within the chamber 22. In the preferred embodiment illustrated, means for variably directing a generally unidirectional beam of light comprises a source of illumination, such as the lightbulb 40, mounted on the platform 38 by a socket 39 and electrically connected to a pair of batteries 44 mounted by brackets 43 and 45 which provide a source of energy to illuminate the lightbulb 40. The batteries 44 are connected in series with the lightbulb 40 through a switch generally designated by the reference numeral 46 (FIG. 3). The switch 46 includes a first metal or conductive contact arm 48 electrically connected to the battery bracket 45. The switch 46 includes a second resilient conductive contact arm 50 electrically connected to the other battery bracket 45. In the normal non-rotating position, the contact arm 50 is spaced from and out of engagement with the contact arm 48 as shown in FIG. 3 and therefore current does not flow to the lightbulb 40 and it is not illuminated.

A weight 52 is secured to the free end of the contact arm 50 such that upon rotation of the spindle 32, the centrifugal force acting on the resilient contact arm by the weight 52 causes the contact arm 50 to flex outwardly and away from the contact arm 48. A stop surface 54 is provided on the platform 38 to limit the outward movement of the contact arm 50 under the influence of the centrifugal force.

Once the rotation of the spindle 32 is terminated, the centrifugal force tending to move the contact arm 50 away from the contact arm 48 is removed resulting in the contact arm 50 springing back to engage the contact arm 48. The contact arm 50 at the termination of the rotation of the platform 38 will tend to flex back and forth or vibrate about its connection to the battery bracket 45 for a brief period of time thus alternately contacting the contact arm 48 and alternately illuminating the lightbulb 40 producing a flashing effect. This flashing beam will be emitted through one of the windows 28 and may be focused by a lens if desired.

Figure 4:
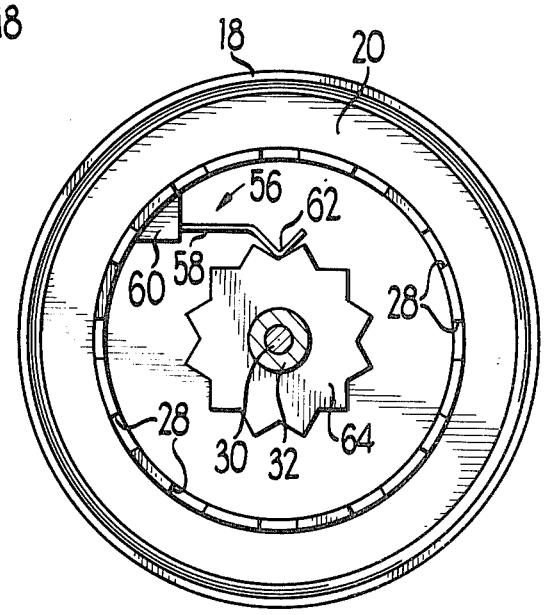
FIG. 4 is a view taken along line 4—4 of FIG. 2.

In accordance with a feature of the present invention, means are provided to stop the rotation of the spindle 32 so that the lightbulb 40 will be adjacent one of the apertures 28. This indexing or termination means is accomplished by a device generally designated by the reference numeral 56 (FIG. 4). The indexing device 56 includes a spring arm 58 secured to a mounting block 60 that is secured to the bottom 20 of the base 18. The spring arm 58 includes an angled portion 62 that engages a star wheel or gear 64 integrally formed or secured to the spindle 32. Thus, as the spindle 32 is rotated, the spring 58 and specifically the angled portion 62 engages the individual teeth of the star wheel 64 tending to slow down and terminate the rotation of the gear 64. In addition, due to the configuration of the outer periphery of the star wheel 64 and the forces applied by the angled portion 62 of the spring 58, the rotation of the spindle 32 will stop at a location where the angled portion 62 is positioned at the valley between two teeth defined on the star wheel 64, predetermining the circumferential location at which the lightbulb 40 will stop. These locations and, thus, the distance between the teeth of the star wheel 64 are predetermined to correspond to the locations of the apertures 28 such that the lightbulb 40 will always be located adjacent one of the apertures 28 at the termination of the rotation of the spindle thus randomly selecting one of the apertures 28.

Once the lightbulb 40 comes to a halt adjacent one of the apertures 28 and since the star wheel 64 provides a relatively abrupt termination of radiation of spindle 32, the contact arm 50, during its swinging or vibrating motion will emit a beam through the selected aperture 28 producing a flashing effect along a radial direction away from the chance apparatus 10.

The invention includes a game board 12 for use with the chance device 10. The game board includes indicia on the surface defining a central location 64 on which the chance device 10 is to be placed (FIG. 1). In addition, radial lines 66 extending away from the location 64 and along a radial direction corresponding to the apertures 28 are also defined. In the preferred embodiment illustrated, concentric bands such as bands 68 are also defined and may be of different colors. Moreover, specific playing stations such as stations 70 may also be defined on the board 12 and different playing objects such as the spheres 72 and the square tubular section 74 may be included.

In one scheme of play, the following rules may be incorporated to play a game based on a space wars theme using the chance device 10, the playing pieces 72 and 74 and the game board 12. The object of this game is to capture a spherical playing piece 72 representing an "Assault Pod" spawned by the laser armed alien "Galactic Cruiser", the chance device 10. The "pods" are captured by the playing pieces 74 which represent "Defense Ships". During the first turn of each player, the player spins the spindle 32, the "energy cone" and places a Defense Ship 74 at the outermost band 68 and along the radial line 62 indicated by the flashing beam or "Laser Beam" of the Galactic Cruiser 10. At the second and subsequent turns of each player, a Defense Ship 74 is moved forward or backward one band 68 and if that band is occupied by one of the Pods 72, that Pod is considered to have been captured. If the radial line 66 selected by the Galactic Cruiser 10 includes one of the Defense Ships 74 owned by the player who spun the energy cone of the Galactic Cruiser 10, any captured Pod 72 is returned to the board 12 and the Defense Ship 74 is removed from the board. If a Defense Ship 74, owned by a player other than that player that spun the cone, is positioned on the radial line 66 selected by the Galactic Cruiser 10, a Pod 72 on that radial line 66 captured by that Defense Ship 74 is removed from the board 12.

If the player, other than the player who spun the Galactic Cruiser 10 who loses a Defense Ship 74 has any "neutralized" Pods (to be defined below), the player who spun the Galactic Cruiser 10 may take those "neutralized" Pods 72 when an unoccupied radial line 66 is selected by the laser beam, the player spinning the energy cone of Galactic Cruiser 10 may place a second Defense Ship 74 on the outer band 68 of the selected line 66. If that player already has two Defense Ships 74 on the board 12, that player may move one of his Defense Ships 74 onto that newly selected radian 66.

To "neutralize" a Pod 72, the player must move the Defense Ship 74 along a selected radian 66 capturing all the Pods 72 lying on that radian 66 and then return his Defense Ship 74, with the captured Pods 72, to the outermost band 68 without having the Galactic Cruiser 10 select that particular radian 66 during this movement. Once having returned to the outer band 68, if the player then spins the Galactic Cruiser 10 and the Laser Beam does not select the particular radian 66 on which the Defense Ship 74 is located, the Pods 72 may be completely removed from the board and are "neutralized" for the rest of the game and can only be lost to another player if the Defense Ship 74 lies on a radian 66 selected by the Laser Beam upon a spin of another player.

The end of the game occurs when all the Pods 72 have been captured and "neutralized" and the player with the most Pods 72 wins the game.

Obviously, many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. A chance device for randomly selecting a direction, comprising:
a housing;
illumination means for providing a generally unidirectional beam;
movable means on said housing for variably directing the orientation of said unidirectional beam relative to said housing; and
inertial switch means for intermittently energizing said illumination means upon the termination of movement of said movable means.

2. The chance device claimed in claim 1 wherein said illumination means includes a power supply on a lightbulb connectable therewith.

3. The chance device of claim 1 including means for providing friction to retard and terminate the movement of said movable means.

4. The chance device of claim 1 wherein said movable means is rotatable and said inertial switch means for intermittently energizing said illumination means comprises a switch means having an element responsive to the movement of said movable means.

5. The chance device claimed in claim 4 wherein said switch means comprises first and second conductive members mounted on said movable means, said second member being formed of resilient material and spaced from said first member in a normal condition and movable under the influence of centrifugal force upon rotation of said movable means.

6. The chance device claimed in claim 1 further comprising indexing means to stop the movement of said movable means at one of a plurality of predetermined positions.

7. The chance device claimed in claim 6 further comprising a game board including radial indicia thereon extending in directions corresponding to at least some of said predetermined positions.

8. A chance device for randomly selecting radial directions, comprising:
a frame;
means rotatably mounted on said frame including at least a manually graspable portion to facilitate rotation thereof;
a source of illumination on said rotating means;
means for allowing emission of illumination from said frame at predetermined positions;
an indexing means for engaging said rotating means to positionably align said source of illumination with one of said predetermined positions; and
centrifugally actuatable switch means for intermittently energizing said source of illumination upon the termination of rotation of said rotating means.

9. The device set forth in claim 8 wherein said switch means includes at least one switch blade including a weight secured to a free end thereof secured to rotatable means.

10. The chance device claimed in claim 9 further comprising a game board including radial indicia thereon extending in directions corresponding to at least some of said predetermined positions.

11. A rotating chance device for randomly selecting a radial direction by directing a beam of illumination along said direction, comprising:
a housing defining an internal chamber;
a plurality of apertures defined in said housing at locations corresponding to said radial directions;
a spindle rotatably mounted on said housing and adapted for manual rotation;
a source of illumination secured to said spindle and rotatable therewith; and
a centrifugally actuated switch means coupled to said source of illumination to intermittently energize said source of illumination upon selection of said radial direction.

12. The chance device set forth in claim 11 further including an indexing device mounted on said housing for engaging said spindle, said indexing device including a position member secured to said spindle including discrete positions corresponding to said locations of said apertures and an engagement member resiliently engaging said position member.

13. The chance device set forth in claim 11 wherein said switch means includes a first switch blade electrically coupled to said source of illumination and a second switch blade resiliently coupled to said source of illumination and normally spaced from said first switch blade, and a weight secured to said second blade at a located space from the point of securement of said second blade to said source of illumination.

14. The chance device set forth in claim 11 further comprising a game board including a first, central location for the positioning of said chance device and indicia including radial lines extending from said central location corresponding with said apertures.

15. In combination
a chance device for randomly selecting a radial direction comprising a housing, a source of illumination, means for rotatably mounting said source of illumination in said housing, and means for allowing the emission of illumination from said housing along said direction, said chance device comprising a centrifugally operated switch for intermittently energizing said source at said radial direction, said switch including first and second switch contacts spaced from each other in the normal position, said first contact including a weight secured thereto to vibrate and alternately contact said second contact after termination of rotation; and
a game board including indicia defining a location for the placement of said chance device and lines radially extending from said location each corresponding to a radial direction that may be selected by said chance device.

16. The combination claimed in claim 15 further including an indexing mechanism mounted on said housing and engaging said rotating means, said indexing mechanism includes a position member including a plurality of positions defined thereon corresponding to said radial directions and an engagement member engaging said position member.

* * * * *